US011241061B2

(12) United States Patent
Liao et al.

(10) Patent No.: US 11,241,061 B2
(45) Date of Patent: Feb. 8, 2022

(54) HELMET SHIELD OPENING MECHANISM AND HELMET WITH CHANGEABLE JAW GUARD EQUIPPED WITH THE SAME

(71) Applicant: JIANGMEN PENGCHENG HELMETS LTD., Heshan (CN)

(72) Inventors: Haotian Liao, Heshan (CN); Xinsheng Liu, Heshan (CN)

(73) Assignee: JIANGMEN PENGCHENG HELMETS LTD., Heshan (CN)

( * ) Notice: Subject to any disclaimer, the term of this patent is extended or adjusted under 35 U.S.C. 154(b) by 182 days.

(21) Appl. No.: 16/715,171

(22) Filed: Dec. 16, 2019

(65) Prior Publication Data

US 2020/0113268 A1 Apr. 16, 2020

Related U.S. Application Data

(63) Continuation of application No. PCT/CN2018/071507, filed on Jan. 5, 2018.

(30) Foreign Application Priority Data

Aug. 14, 2017 (CN) ..... 201710693342.X

(51) Int. Cl.
*A42B 3/32* (2006.01)
*A42B 3/22* (2006.01)

(52) U.S. Cl.
CPC ..... *A42B 3/326* (2013.01); *A42B 3/223* (2013.01)

(58) Field of Classification Search
CPC ..... A42B 3/326; A42B 3/223; A42B 3/222; A42B 3/04; A42B 3/205; A42B 3/221
See application file for complete search history.

(56) References Cited

U.S. PATENT DOCUMENTS 6,892,400 B1 5/2005 Choi et al.
8,156,574 B2 4/2012 Stokes et al.
(Continued)

FOREIGN PATENT DOCUMENTS

CN 1636475 A 7/2005
CN 101331994 A 12/2008
(Continued)

OTHER PUBLICATIONS

International Search Report issued by the State Intellectual Property Office of the P.R. China for corresponding International Patent Application No. PCT/CN2018/071507, dated May 16, 2018, with an English translation.

*Primary Examiner* — Khaled Annis
(74) *Attorney, Agent, or Firm* — Myers Wolin, LLC

(57) ABSTRACT

A helmet shield opening mechanism is provided, wherein first and second constraint tracks are provided on at least one support leg of a shield jaw guard, and a driver element is configured to come into contact with and drive the two tracks, so that the helmet has forced and controlled modes relative to the opening action and process of the helmet body. On one hand, the operational reliability and flexibility of the shield opening mechanism can be improved; on the other hand, the shield is opened smoothly without collision, thus improving the wearing comfort of the helmet. Further, a helmet with changeable jaw guard equipped with the helmet shield opening mechanism can plan the opening process of the shield flexibly to adapt to states of the jaw guard at different operation positions, thereby greatly reducing the chances of collision between the jaw guard and the shield.

12 Claims, 15 Drawing Sheets

(56) References Cited

U.S. PATENT DOCUMENTS

| | | | |
|---|---|---|---|
| 8,572,767 | B2 | 11/2013 | Bryant et al. |
| 9,032,557 | B2 | 5/2015 | Bryant et al. |

FOREIGN PATENT DOCUMENTS

| | | | |
|---|---|---|---|
| CN | 101991208 | A | 3/2011 |
| CN | 203040824 | U | 7/2013 |
| CN | 103391727 | A | 11/2013 |
| CN | 105901820 | A | 8/2016 |
| CN | 107432520 | A | 12/2017 |
| ES | 2 329 494 | T3 | 7/2007 |
| WO | 2006/045912 | A1 | 5/2006 |

HELMET SHIELD OPENING MECHANISM AND HELMET WITH CHANGEABLE JAW GUARD EQUIPPED WITH THE SAME

CROSS REFERENCE TO RELATED APPLICATIONS

This application is a continuation of International Application No. PCT/CN2018/071507, filed on Jan. 5, 2018, which takes priority from Chinese Patent Application No. 201710693342.X, filed on Aug. 14, 2017, the contents of each of which are incorporated by reference herein.

TECHNICAL FIELD

The disclosure relates to a helmet for protecting the human head, particularly to a helmet for wear by special operation personnel as well as automobile drivers and aircraft pilots, and more particularly to an opening mechanism for opening a closed shield and a helmet with changeable jaw guard equipped with the opening mechanism.

BACKGROUND

As is well-known, a helmet should be worn by workers operating in many special occasions to protect their heads, such as in painting workshops, fire and disaster relief sites, anti-terror and riot control occasions and other occasions such as mining, coal-mining, excavation and underground tunnel operation environments, as well as driving automobiles, racing cars and aircrafts, etc. A typical helmet generally includes a helmet shell body, a shield and a jaw guard, wherein the shield and the jaw guard are mounted on the helmet shell body and the shield may perform and show an opening or closing pose with respect to the helmet shell body as required. The shield is made of a transparent material and serves to prevent intrusion of dust, rain, smoke and other harmful particles and raindrops. In particular, the shield can prevent the eyelids from branches, flying stones and even explosives. The jaw guard plays a role of effectively protecting the wearer's jaw, mouth, face and other important organs in case of impact or other events.

In fact, it is often necessary to open the shield from time to time in the process of wearing and using a helmet in order to be able to communicate with the outside or to disperse the water mist gathered inside the helmet due to the driver's breathing. For those helmets with a changeable jaw guard, e.g., the helmets mentioned in Spanish patent application ES2329494T3 and Chinese patent applications ZL201010538198.0 and CN105901820A filed by the present applicant, there is another concern about opening the shield, i.e., preventing collision between the shield and the jaw guard, that is to say, the opening of the shield must be matched to and correlated with the operation state of the jaw guard. In other words, when the jaw guard is in a transition state between the full-helmet structure and the half-helmet structure, the shield must be in an open position timely to avoid damage of the jaw guard due to collision with the closed shield when returning to the full-helmet structure position.

In fact, the opening of existing helmet shields (including the helmets referred to in Spanish patent application ES2329494T3 and Chinese patent applications ZL201010538198.0 and CN105901820A filed by the present applicant) is performed mostly by means of a bounce spring, during which the shield in a closed state is first triggered by hand to unlock the shield, and then the shield is automatically opened by pre-compression or pre-extension energy of the bounce spring. Such arrangement as the advantage that the shield can be opened automatically, so it is very convenient to open the shield. However, the solution for opening the shield by the bounce spring still has shortcomings: 1) The presence of the spring inevitably leads to complexity in design of the shield and the helmet body and lower operational reliability of the shield, since either a torsion spring or a spiral spring or a tension spring inevitably occupies a certain space to realize the release and compression of the spring and must also be configured with corresponding accessory members such as locking members or thrust members, anti-drop members, even follow-up slider members, etc. Such reserved space and members configured, on the one hand, occupy the valuable space of the helmet, and, on the other hand, complicate the helmet design and negatively affect the operational reliability of the shield. In addition, a bounce spring mechanism is highly susceptible to shaking in case of vibration and collision, and even an involuntary unlocking may occur to open the shield in an uncontrolled manner. In other words, the operational reliability of the shield is not high. 2) The presence of the bounce spring may reduce the wearing comfort of the helmet, since the shield is opened by the elasticity of the bounce spring. Practice has proven that the shield based on such mechanism is easy to generate friction and impact noise during opening, especially when the shield is bounced to the extreme high position, the shield will inevitably collide with a limit member to generate a large impact noise, thus not only negatively affecting the operational reliability of the shield and its relevant accessories, but also bringing obvious negative effects to the wearing experience since the bounce spring mechanism is arranged next to the wearer's ear. In other words, the bounce spring will reduce the wearing comfort of the helmet. 3) The opening mechanism based on the bounce spring will cause uncontrollable bouncing of the shield, which is particularly important for the helmet with changeable jaw guard which can perform transition between a full-helmet structure and a half-helmet structure, since the jaw guard of the helmet with changeable jaw guard structure has two states: one is changing the jaw guard from the full-helmet position to the half-helmet position, where the shield must also be in an open state or be opened along with the jaw guard in the process of opening the jaw guard; the other is returning the jaw guard from the half-helmet position to the full-helmet position, where the shield must be opened from a closed state to prevent collision with the jaw guard during returning of the jaw guard. As previously mentioned, the mechanism based on the bounce spring can only keep the shield in two absolute states in which the shield is fully closed or fully opened, i.e., the opening of the shield cannot be planned according to the operation state of the jaw guard. In other words, the opening process of the shield cannot be controlled flexibly.

In conclusion, the existing shield opening mechanisms based on the bounce spring do have short comings in reliability, comfort, flexibility and other aspects, so there is still room for improvement and promotion.

SUMMARY

In view of the above problems in the existing helmet shield opening mechanisms, the present disclosure provides a helmet shield opening mechanism and further provides a helmet with changeable jaw guard equipped with the helmet shield opening mechanism. An objective of the present disclosure is that, through the innovation principle and structural improvement, on one hand, the operational reliability of the shield opening mechanism is improved; on the other hand, the positive influence of the shield opening mechanism on the wearing comfort of the helmet is improved. Moreover, the helmet with changeable jaw guard may achieve that the opening process of the shield is planned flexibly to adapt to different operation positions of the jaw guard.

The objective of the present disclosure is achieved by a helmet shield opening mechanism, which includes a helmet body, a jaw guard and a shield, the shield being provided with two support legs which are rotatably assembled on the helmet body, and the jaw guard being provided with two forks which are respectively arranged beside two sides of the helmet body, wherein a first constraint track and a second constraint track are provided at least on one support leg of the shield, and a driver element, configured to drive the shield to perform the opening action relative to the helmet body by coming into contact with the first constraint track and the second constraint track, is additionally provided.

Further, a clamping structure is provided on the shield, a locking member and a locking spring corresponding to the clamping structure are additionally assembled on the helmet body, the locking member may produce a displacement relative to the helmet body under the action of the locking spring, and the locking member may be in locking fit with the clamping structure.

Further, the clamping structure and the locking member are both of a toothed structure and may be in locking fit via these toothed structures engaging with each other.

Further, rotation of the support legs of the shield relative to the helmet body is a fixed-axis oscillation.

A portion of the driver element in contact with the first constraint track and that in contact with the second constraint track are both of a cylindrical structure.

A helmet with changeable jaw guard equipped with the helmet shield opening mechanism is provided, wherein the jaw guard is a changeable jaw guard which may produce a relative motion relative to the helmet body, the driver element is constrained and driven by the jaw guard so as to produce displacement and motion relative to the helmet body.

Further, a fixed gear of internal tooth type is provided on the helmet body while a rotary gear of external tooth type is fastened to or integrally formed on the jaw guard. The rotary gear and the fixed gear remain engaging with each other and may restrain the course of motion of the jaw guard.

Further, for the engaged fixed gear and rotary gear, the parameters, such as a pitch radius R of the fixed gear, a pitch radius r of the rotary gear and a corresponding central angle β rotated by an axle centre of the rotary gear when the jaw guard rotates an angle of α relative to the helmet body during the engagement, meet a constraint formula:

$$\frac{R}{r} = 1 + \frac{\alpha}{\beta}.$$

Further, the fixed gear includes a first fixed gear segment and a second fixed gear segment, the rotary gear includes a first rotary gear segment and a second rotary gear segment, and the first rotary gear segment only engages with the first fixed gear segment while the second rotary gear segment only engages with the second fixed gear segment.

Further, an axle centre of the first rotary gear segment overlaps with that of the second rotary gear segment.

Further, a first axle centre trajectory of the first rotary gear segment is tangent to a second axle centre trajectory of the second rotary gear segment at a point where they intersect.

The driver element is fastened to or integrally formed on the jaw guard.

The driver element is fastened to or integrally formed on the rotary gear.

The present disclosure provides a helmet shield opening mechanism, wherein a first constraint track and a second constraint track are provided on at least one support leg of a shield, and a driver element, configured to come into contact with the two tracks to drive the shield to perform an opening action relative to a helmet body, is additionally provided. Therefore, on one hand, the helmet may be opened forcedly as required; on the other hand, the opening process of the shield may be planned flexibly. Meanwhile, the shield can be opened smoothly without collision, thus improving the operational reliability of the shield opening mechanism and its positive influence on the wearing comfort of the helmet. Further, for the helmet with changeable jaw guard equipped with the helmet shield opening mechanism, the opening process of the shield can be designed flexibly to adapt to different operation positions of the jaw guard, and a reliable transition of the jaw guard between a full-helmet position and a half-helmet position in case of being constrained by the gears is achieved, so that the operational reliability of the helmet can be effectively improved.

DETAILED DESCRIPTION

Embodiments of the present disclosure will be further described below with reference to FIGS. 1 to 15.

A helmet shield opening mechanism is provided, including a helmet body 1, a jaw guard 2 and a shield 3. The shield 3 is provided with two support legs 3*a* which are respectively provided beside two sides of the helmet body 1 and rotatablely assembled on the helmet body 1, and the jaw guard 2 is provided with two forks 2*a* respectively arranged beside the two sides of the helmet body 1 (see FIG. 1 to FIG. 8), wherein a first constraint track 3*b* and a second constraint track 3*c* are provided at least on one support leg 3*a* of the shield 3, and a driver element 4, which may come into contact with the first constraint track 3*b* (see FIGS. 5A-D) and/or the second constraint track 3*c* on the support legs 3*a* to drive the shield 3 to perform an opening action with respect to the helmet body 1 (see FIGS. 6A-D), is additionally provided. The driver element 4 may be triggered by a helmet wearer directly by using his/her hand or indirectly by using other parts or mechanisms, in particular by using the jaw guard 2 of the helmet which in turn triggers the driver element 4 (which is the case provided in FIG. 7 and FIG. 8).

Figure 1:
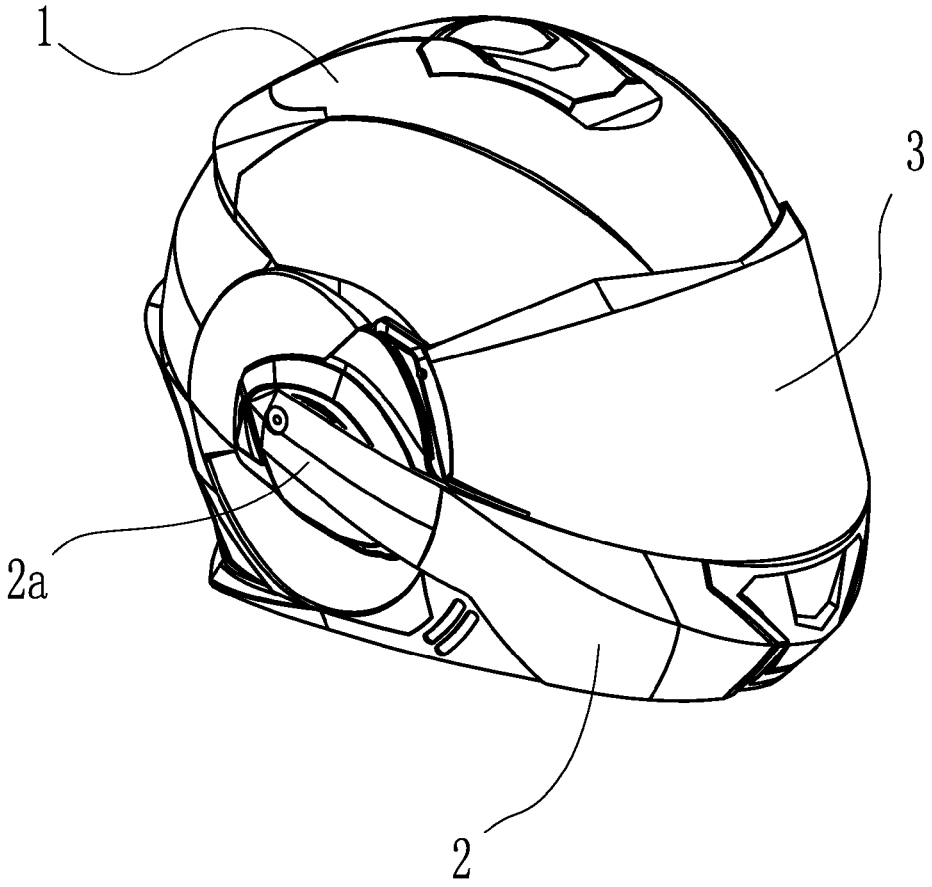
FIG. 1 is an axonometric diagram of a helmet shield opening mechanism and a helmet equipped with this mechanism according to the present disclosure.
Figure 2:
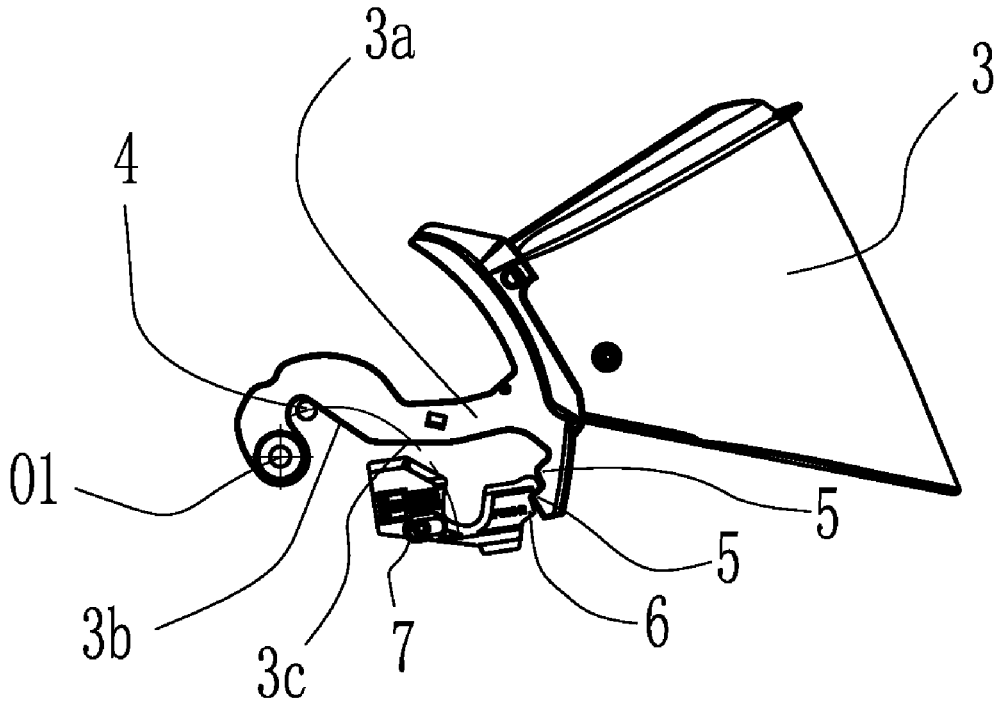
FIG. 2 is a schematic diagram of the structural arrangement of a shield and a locking means of the helmet shield opening mechanism according to the present disclosure.
Figure 3:
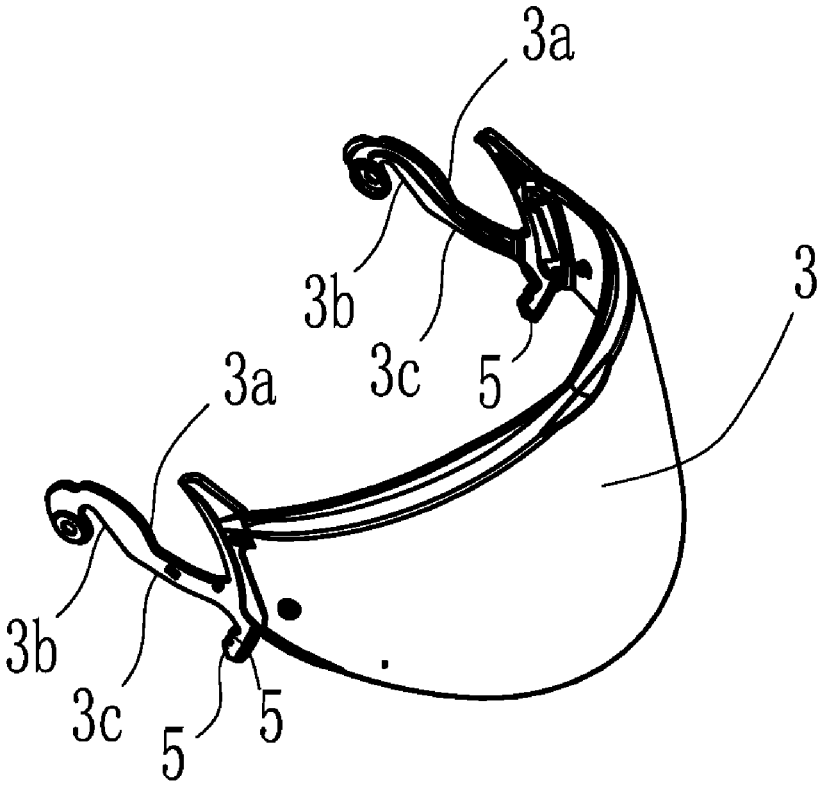
FIG. 3 is an axonometric drawing of the shield of the helmet shield opening mechanism according to the present disclosure.
Figure 4:
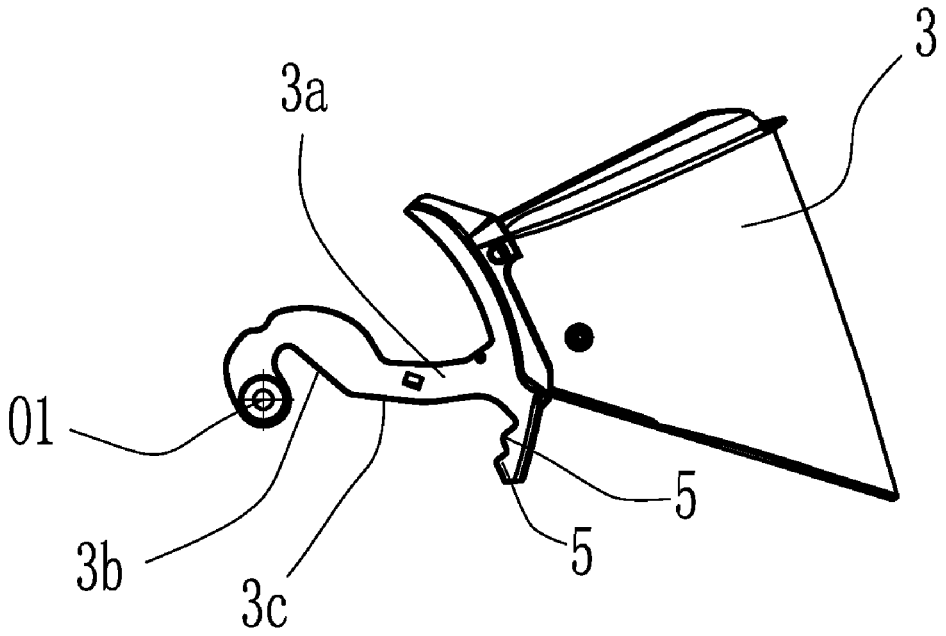
FIG. 4 is a front view of a side elevation of the shield as shown in FIG. 3.
Figures 5A, 5B, 5C, 5D:
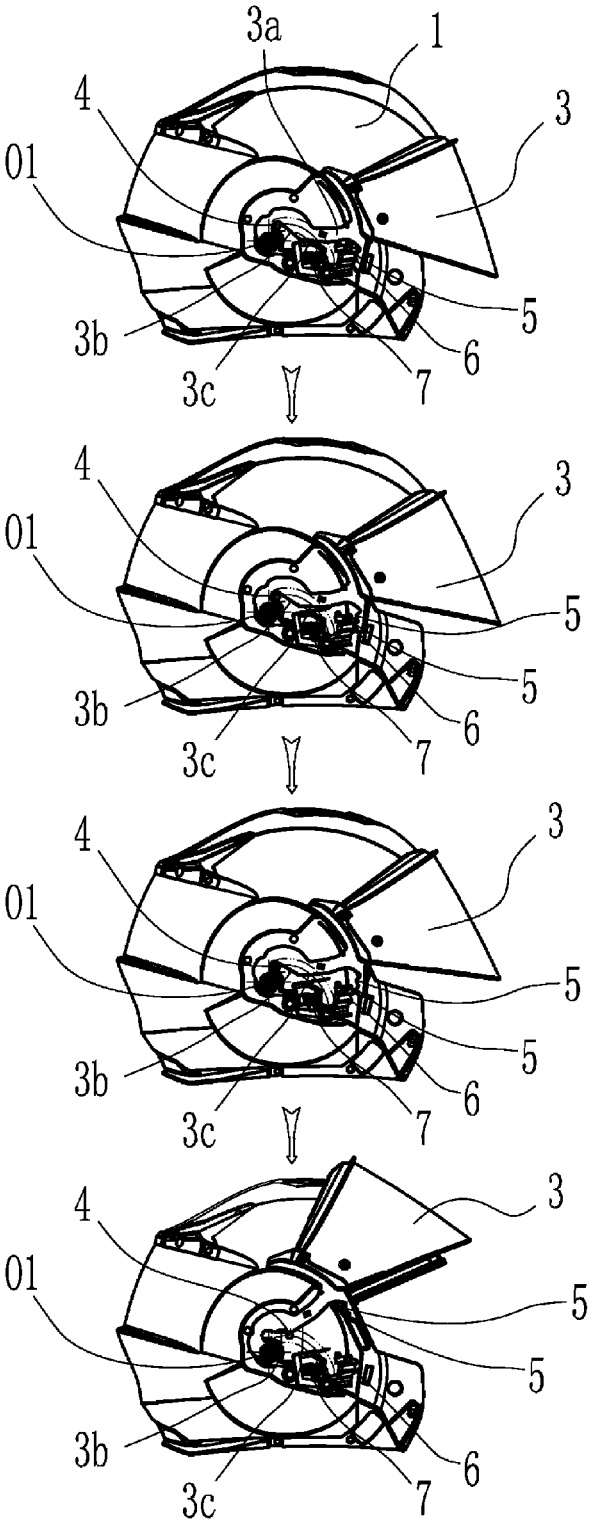
FIGS. 5A-D are schematic diagrams showing a process in which a driver element of the helmet shield opening mechanism comes into contact with a first constraint track to drive the shield to change from a closed position to a fully open position according to the present disclosure.

In FIGS. 5A-D, the driver element 4 moves from an extreme position as shown in FIG. 5A where it is located (at this moment, the shield 3 may be in a fully closed state, i.e., in a state in which the eyes of the helmet wearer may be protected) to a position in FIG. 5B and then to a position in FIG. 5C so as to come into contact with and drive the first constraint track 3*b* to enable the shield 3 to perform an opening action and an opening process towards the helmet body 1 until it moves to a position as shown in FIG. 5D where the shield 3 is in a fully open position.

Figures 6A, 6B, 6C, 6D:
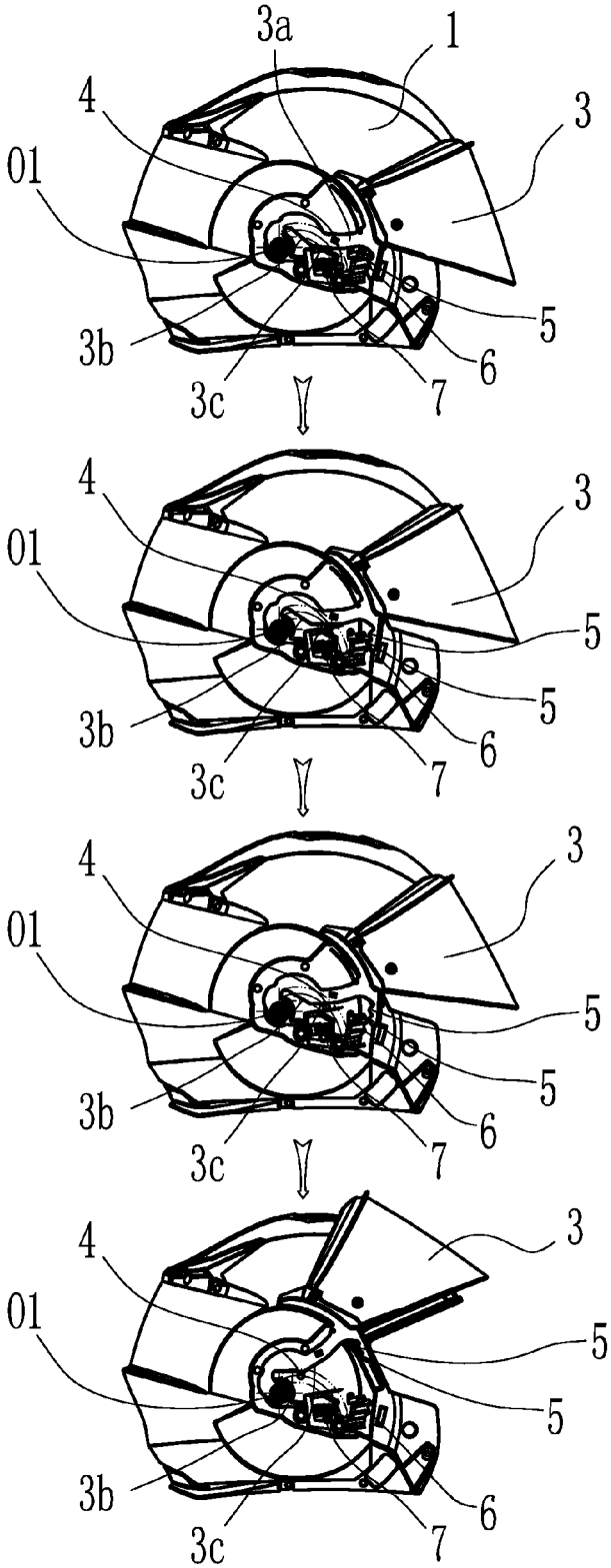
FIGS. 6A-D are schematic diagrams showing a process in which the driver element of the helmet shield opening mechanism comes into contact with a second constraint track to drive the shield to change from the closed position to the fully open position according to the present disclosure.
Figure 7:
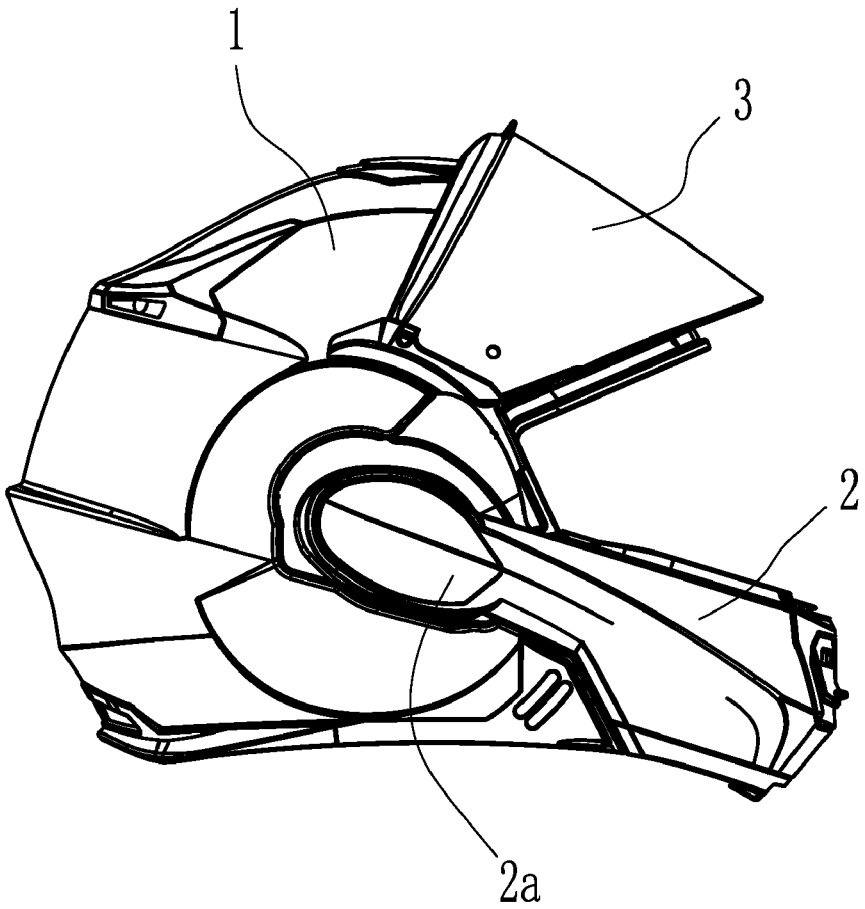
FIG. 7 is a front view of a profile of a helmet with changeable jaw guard equipped with the helmet shield opening mechanism which consists of the driver element, the first constraint track and the second constraint track according to the present disclosure.

However, in FIGS. 6A-D, the driver element 4 moves from the other extreme position as shown in FIG. 6A where it is located (at this moment, the shield 3 may also be in a fully closed state, i.e., in a state in which the eyes of the helmet wearer may be protected) to a position in FIG. 6B and then to a position in FIG. 6C so as to come into contact with and drive the second constraint track 3*c* to enable the shield 3 to perform an opening action and an opening process toward the helmet body 1 until it moves to a position shown in FIG. 6D where the shield 3 is in a fully open position.

Here, the first constraint track 3*b* and the second constraint track 3*c* may be in the form of a unilateral rail (as shown in FIG. 2 to FIG. 6D) or in the form of a bilateral rail such as a chute (not shown), wherein when the driver element 4 comes into contact with the first constraint track 3*b* or the second constraint track 3*c* and drives the shield 3 to act via the two tracks, the shield 3 will perform a forced opening action relative to the helmet body 1 (as shown in FIGS. 5A-D and FIGS. 6A-D). It should be noted that the first constraint track 3*b* and the second constraint track 3*c* may be provided on either one or both of the support legs 3*a* of the shield 3, with best situation being that the support legs 3*a* of the shield 3 are both provided with the first constraint track 3*b* and the second constraint track 3*c*.

The present disclosure may adjust and control the position and the posture of the opening process of the shield 3 by planning and selecting the first constraint track 3*b* and the second constraint track 3*c* of different forms, trends and contours, so that the opening process of the shield 3 may be controlled and planned. In addition, since the driver element 4 comes into contact with the first constraint track 3*b* or the second constraint track 3*c* in a manner of sliding fit to drive the two tracks into motion, the driving process is smooth and stable. In other words, impact damage and impact noise may be effectively prevented, thereby effectively improving the wearing comfort of the helmet.

It should be noted that the first constraint track 3*b* and the second constraint track 3*c* may intersect (as shown in FIG. 2 to FIG. 6D) or not (not shown), wherein the intersection may be either a direct intersection or an intersection in the form of a transition track such as a circular transition track. In case of intersection, the intersected constraint track 3*b* and second constraint track 3*c* may be driven by only one driver element 4, so that the simplest structural arrangement which is also the best form may be obtained. And in case of no intersection, it is necessary to provide more than one driver element 4 to drive the two tracks, respectively. Here, the intersection may be either a direct intersection or a situation in which the two tracks are connected to each other by a transition arc, wherein the transition arc connection is most preferred because it allows for more flexible arrangement and design of the first constraint track 3*b* and the second constraint track 3*c*.

It should be noted that the opening referred to in the present disclosure means that the shield 3 moves from a closed state (i.e., a state in which the shield 3 protects the eyelids) to an open state (i.e., a state in which the mouth or eyelids of the wearer is or are exposed) relative to the helmet body 1. Or at this moment, the shield 3 will move from the closed position to a top position of the helmet.

Furthermore, it should be noted that the purpose of providing the first constraint track 3*b* and the second constraint track 3*c* is that the opening steps or the opening orders of the shield 3 may be selected according to different forms of motion of the driver element 4. For example, the driver element 4 may be arranged to "go" to come into contact with the first constraint track 3*b* so as to drive the shield 3 to perform an opening action. Accordingly, the driver element 4 may be arranged to "return" to come into contact with the second constraint track 3*c* so as to drive the shield 3 to perform an opening action. These situations are described in FIGS. 5A-D and FIGS. 6A-D respectively. FIGS. 5A-D show a situation in which the driver element 4 comes into contact with the first constraint track 3*b* to drive the shield 3 to perform an opening action; FIGS. 6A-D show a situation in which the driver element 4 comes into contact with the second constraint track 3*c* to drive the shield 3 to perform an opening action. Obviously, if FIGS. 5A-D correspond to the "go" of the driver element 4, then FIGS. 6A-D correspond to the "return" of the driver element 4.

As can be seen, according to the present disclosure, the first constraint track 3*b* and the second constraint track 3*c* are provided on the support legs 3*a* of the shield 3, while the driver element 4 corresponding to the two tracks is provided, so that the opening motion and process of the shield 3 may be achieved as required to improve the convenience and reliability for opening the shield 3.

According to the present disclosure, in order to ensure that the shield 3 in the closed state may be locked stably without causing undesired opening due to various factors such as vibration, shaking and impact, a clamping structure 5 is provided on the shield 3. Meanwhile, a locking member 6 and a locking spring 7 corresponding to the clamping structure 5 are assembled on the helmet body 1 (see FIGS. 2, 5A-D and 6A-D), the locking member 6 may produce a displacement relative to the helmet body 1 under the action of the locking spring 7, so that the locking member 6 may come into contact with and be in locking fit with the clamping structure 5. As a result, the shield 3 in the closed state may be locked through locking fit between the locking member 6 and the clamping structure 5 so as to prevent it from being opened uncontrollably when not needed. The situation as shown in FIG. 5A and FIG. 6A is a typical situation in which the locking member 6 and the clamping structure 5 are in locking fit. The situation as shown in FIG. 5B and FIG. 6B is a situation that the locking member 6 and the clamping structure 5 are partially unlocked, i.e., a part of the locking teeth has been disengaged while another part thereof is still engaged (at this moment, the state between the shield 3 and the jaw guard 2 has changed from a completely closed state into a state having some gaps in which the shield 3 is still in a state capable of protecting eyes and face of the helmet wearer on one hand, and can play a ventilation function to disperse the water mist inside the helmet due to the helmet wearer's breathing on the other hand). The situation as shown in FIG. 5C and FIG. 6C is a situation that the locking member 6 and the clamping structure 5 are in an unlocked state in which they are fully disengaged. The situation as shown in FIG. 5D and FIG. 6D is a situation that the shield 3 is driven by the driver element 4 to be in a fully open state so that the shield 3 is fully open.

It should be noted that the locking spring 7 of the present disclosure may be in the form of a pressure spring, an extension spring, a torsional spring, a plate spring or any structural form of other springs or combination thereof, with the locking spring 7 being of a pressure spring structure most preferred (as shown in FIGS. 2, 5A-D and 6A-D). Further, the clamping structure 5 and the locking member 6 may be of various locking fit structures, such as a buckle structure, a spring fastener structure, etc. In particular, the clamping structure 5 and the locking member 6 are both of a toothed structure and may be in locking fit via these toothed structures engaging with each other (as shown in FIGS. 2, 5A-D and 6A-D). The advantage of such arrangement is that a latch structure with simple structure and operational reliability may be obtained.

In the present disclosure, the shield 3 and its support legs 3*a* may perform a certain movement, oscillation or rotation or even combination thereof relative to the helmet body 1. In particular, the shield 3 and its support legs 3*a* may perform a fixed-axis oscillation relative to the helmet body 1 and in this case have a fixed axis of oscillation O1 relative to the helmet body 1 (see FIG. 2, FIG. 4A to FIG. 6D). The advantage of such arrangement is that the structure of the shield 3 may be simplified and the reliability thereof may be improved.

In the present disclosure, a portion of the driver element 4 in contact with the first constraint track 3*b* and that in contact with the second constraint track 3*c* are both of a cylindrical structure (see FIGS. 5A-D and FIGS. 6A-D). In this way, since the cylindrical structures may adapt to different poses (i.e., position and posture) of the driver element 4, it is ensured that the driver element 4 is in smooth contact with the first constraint track 3*b* and the second constraint track 3*c* when in different operation positions, thereby facilitating driving the first constraint track 3*b* and the second restraining track 3*c* smoothly.

Figure 13A:
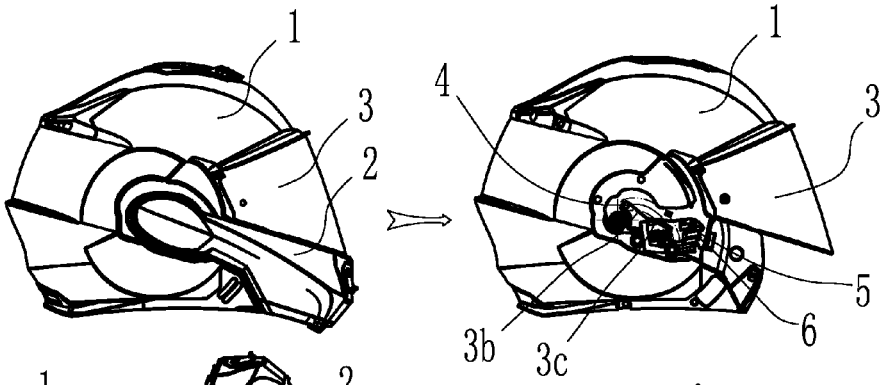
FIGS. 13A-D are schematic diagrams of a process for changing state of the shield opening mechanism when the helmet with changeable jaw guard as shown in FIG. 7 is changed from a full-helmet structure position to a half-helmet structure position.
Figure 13B:
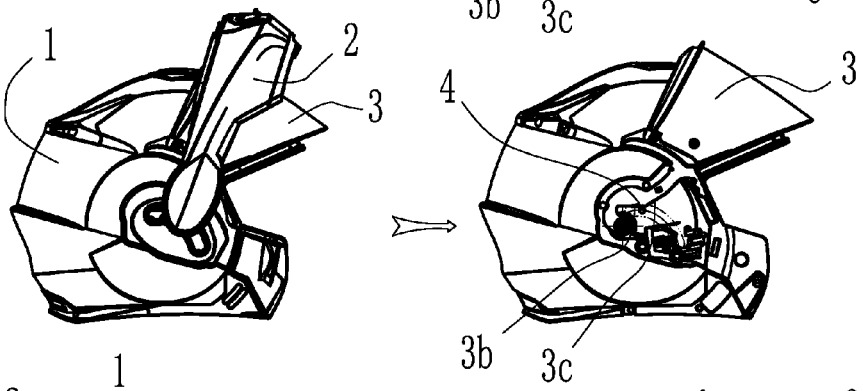
Figure 13C:
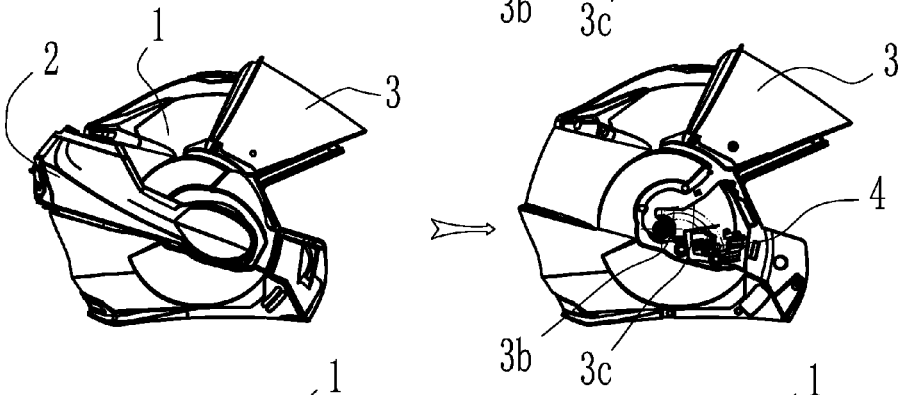
Figure 13D:
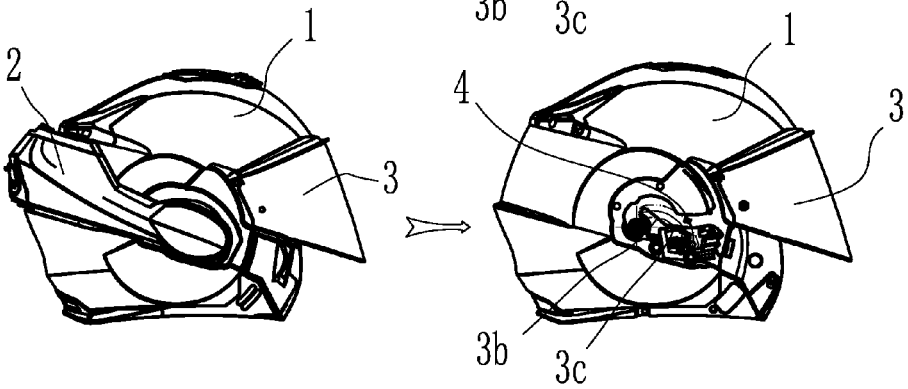
Figure 14A:
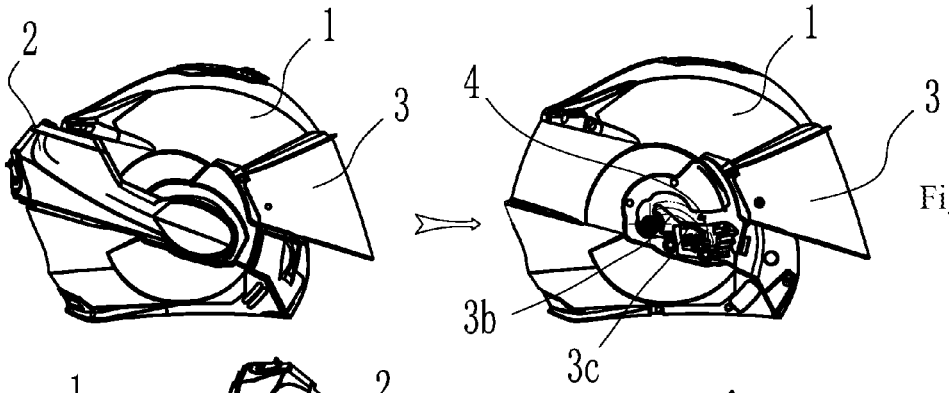
FIGS. 14A-D are schematic diagrams of a process for changing state of the shield opening mechanism when the helmet with changeable jaw guard as shown in FIG. 7 is changed from a half-helmet structure position to a full-helmet structure position.
Figure 14B:
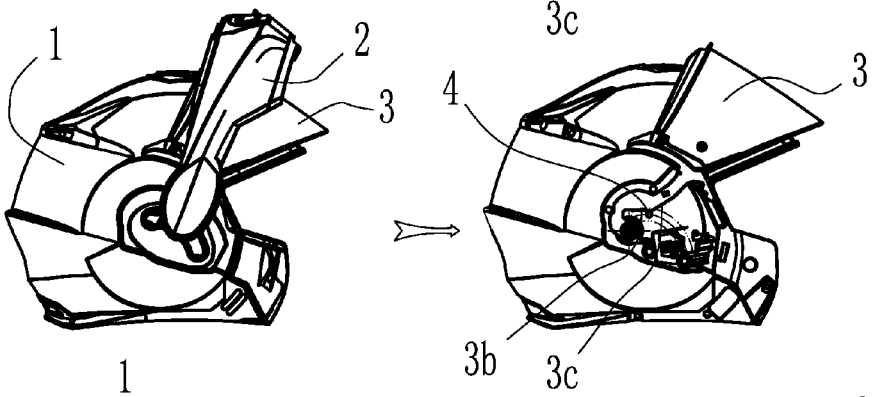
Figure 14C:
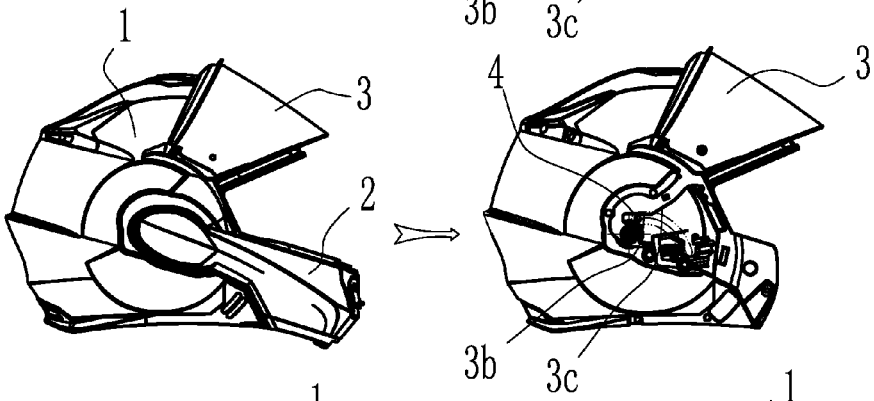
Figure 14D:
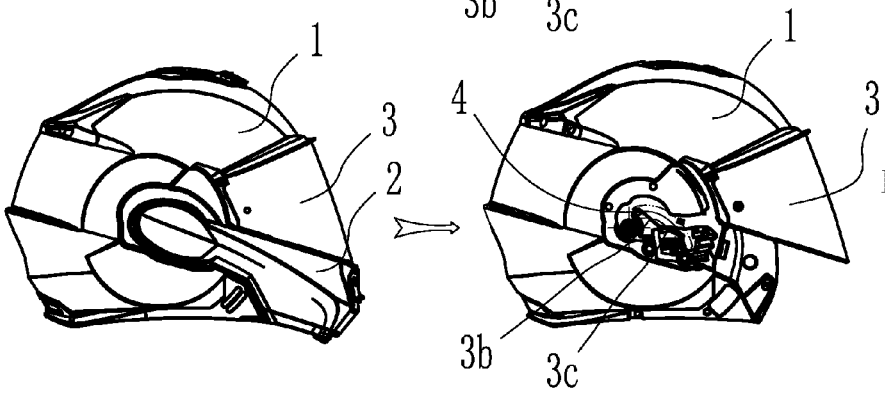

A helmet with changeable jaw guard equipped with the helmet shield opening mechanism according to the present disclosure (see FIGS. 1, 7, 13A-D and 14A-D) is provided, the shield opening mechanism is the above-described opening mechanism facing the shield 3, including a first constraint track 3*b* and a second constraint track 3*c* provided on a support leg 3*a* of the shield 3, and further including a driver element 4, wherein the jaw guard 2 is a changeable jaw guard which may perform relative motion relative to the helmet body 1, i.e., the structure and position of the jaw guard 2 may be changed as required. In particular, the jaw guard 2 may achieve transition between a full-helmet structure position and a half-helmet structure position. In other words, the helmet may be a helmet with a full-helmet structure and may also be transformed into a helmet with a half-helmet structure. In case of the helmet with the full-helmet structure, the wearer may be protected well; in case of the helmet with the half-helmet structure, the wearer may communicate with the outside world easily. FIGS. 13A, 14C and 14D reflect the state in which the jaw guard 2 is in the full-helmet structure state, and FIGS. 13C, 13D and 14A reflect the state in which the jaw guard 2 is in the half-helmet structure state. In the present disclosure, the jaw guard 2 with a changeable structure constrains and drives the driver element 4 to operate so as to enable the driver element 4 to produce a displacement and a motion relative to the helmet body 1. As a result, the driver element 4 comes into contact with the first constraint track 3*b* and/or the second constraint track 3*c* to drive the shield 3 to perform an opening motion. In other words, the power for opening the shield 3 may be derived from the jaw guard 2. In this way, the jaw guard 2 may be pulled by the helmet wearer by hand to further trigger and drive the shield 3 to perform an opening motion.

Figure 8:
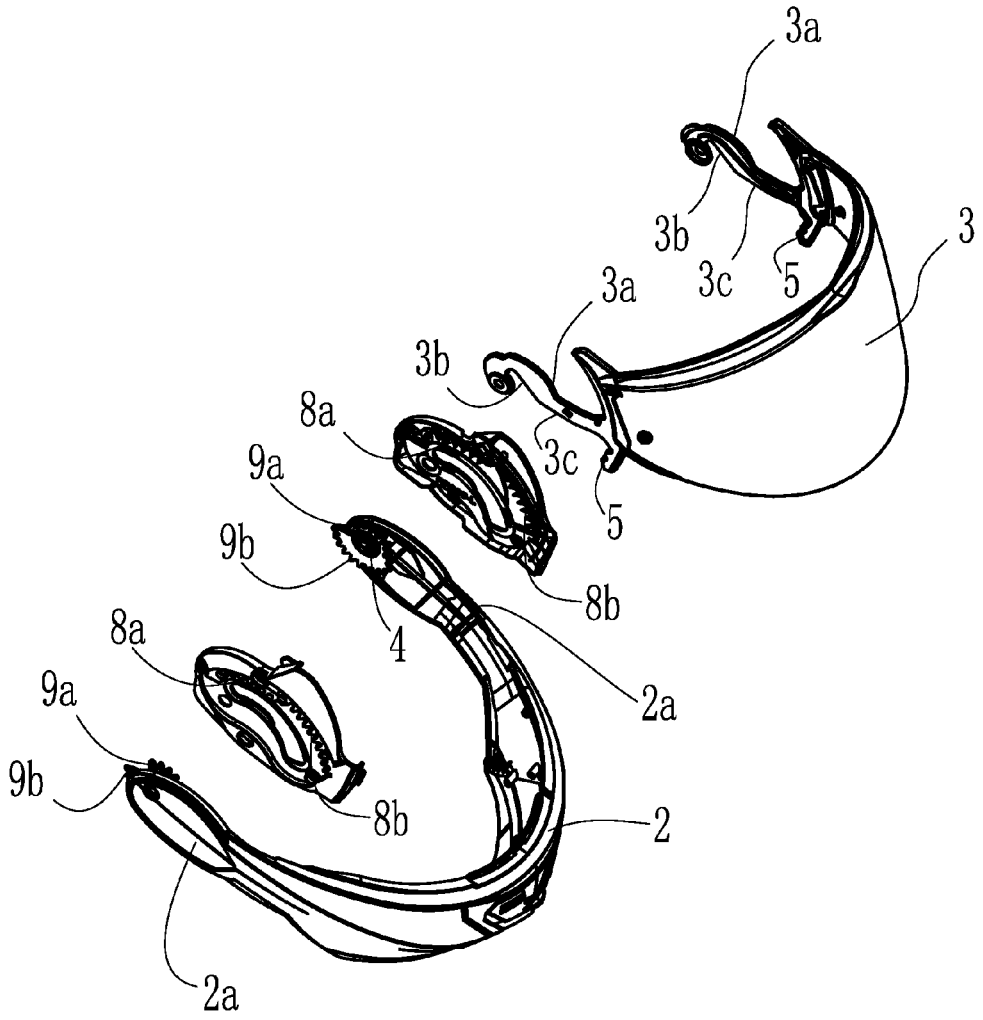
FIG. 8 is an exploded view of main components of a gear constraint mechanism used in a jaw guard of the helmet with changeable jaw guard as shown in FIG. 7 and the opening mechanism provided on the shield.

Further, in the helmet with changeable jaw guard equipped with the helmet shield opening mechanism, a fixed gear 8 of internal tooth type is provided on the helmet body 1 while a rotary gear 9 of external tooth type is fastened to or integrally formed on the jaw guard 2. The rotary gear 9 and the fixed gear 8 remain engaging with each other and may restrain the course of motion of the jaw guard 2. Here, the fixed gear 8 is relatively stationary with respect to the helmet body 1, may be formed separately and then fastened to the helmet body 1 and may also be integrally formed on the helmet body 1, and the situation in which the fixed gear 8 is formed separately is shown in FIG. 8 to FIG. 10.

In the present disclosure, the rotary gear 9 may produce a displacement relative to the helmet body 1. Not only the rotary gear 9 may rotate around its own axle centre02, but also the axle centre02 may produce a relative motion relative to the helmet body 1 at the same time. In particular, the axle centre02 may perform a motion in the form of a circular trajectory (i.e., the axle centre02 has a fixed axis 03 which is stationary with respect to the helmet body 1 as shown in FIG. 9).

Figure 9:
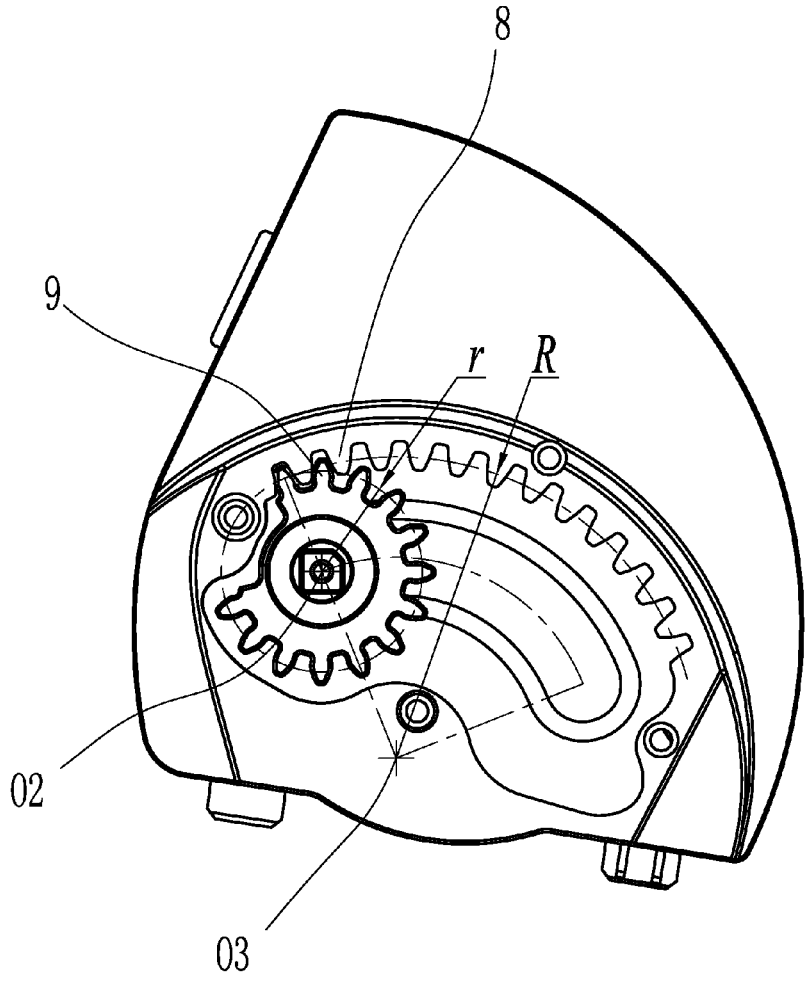
FIG. 9 is a structural diagram showing that a rotary gear and a fixed gear of the gear constraint mechanism used in the jaw guard of the helmet with changeable jaw guard as shown in FIG. 7 are both in the form of a gear segment.
Figure 10:
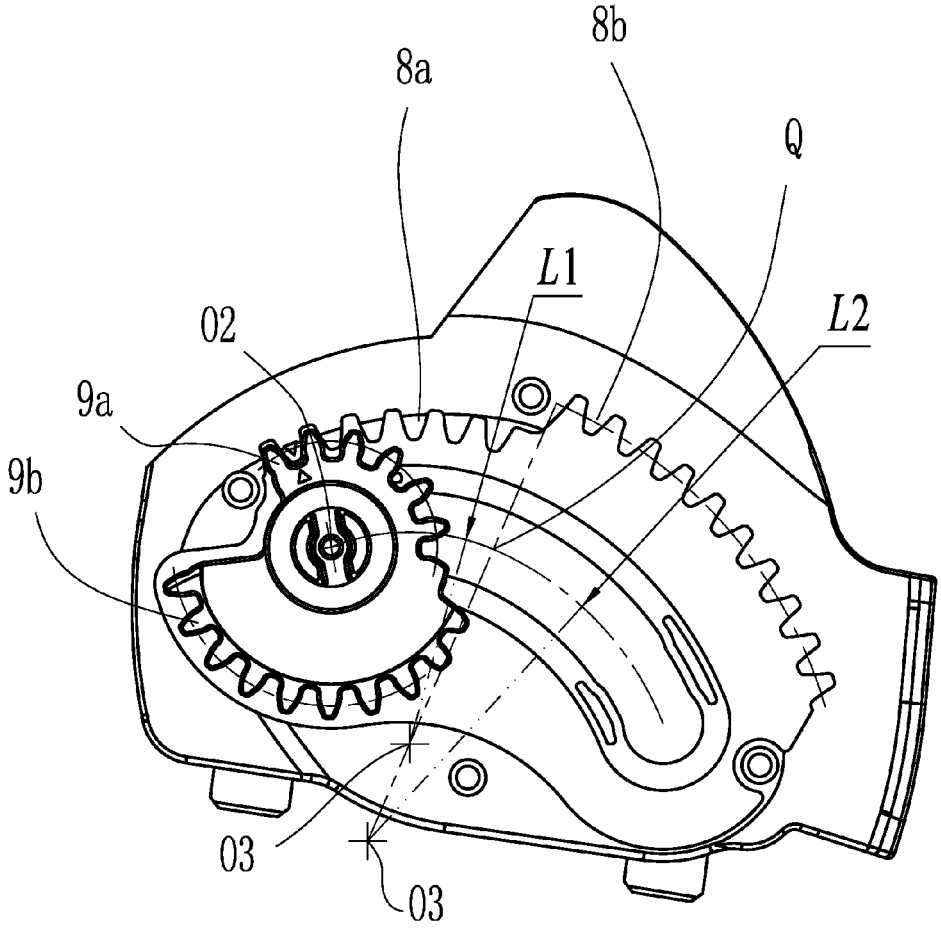
FIG. 10 is a structural diagram showing that a rotary gear and a fixed gear of the gear constraint mechanism used in the jaw guard of the helmet with changeable jaw guard as shown in FIG. 7 are both in the form of two gear segments.
Figure 11:
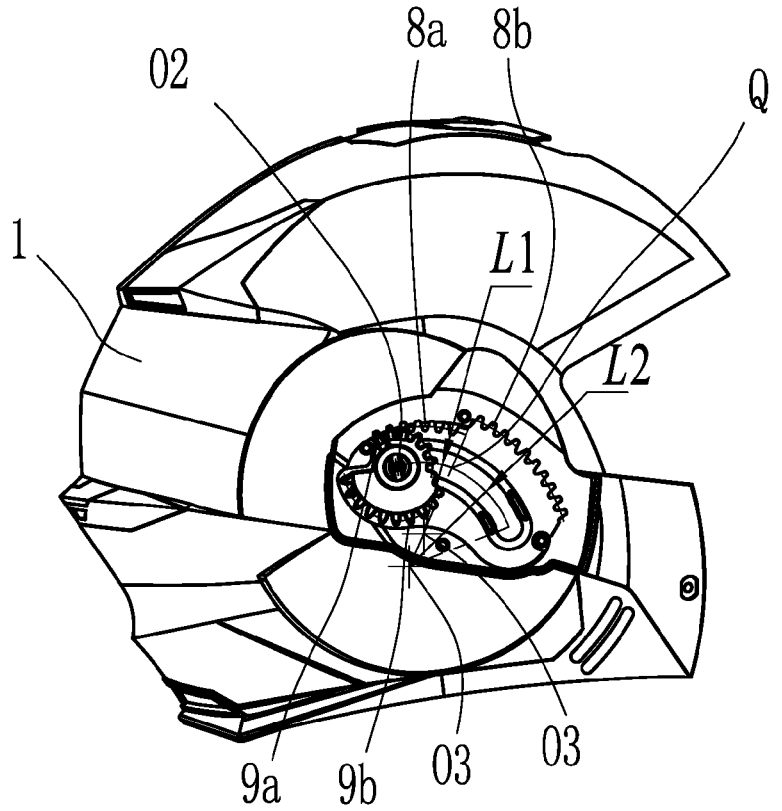
FIG. 11 is a schematic diagram of an embodiment of a relative arrangement between the gear constraint mechanism in the form of two gear segments used in the helmet with changeable jaw guard as shown in FIG. 7 and the helmet body.
Figure 15:
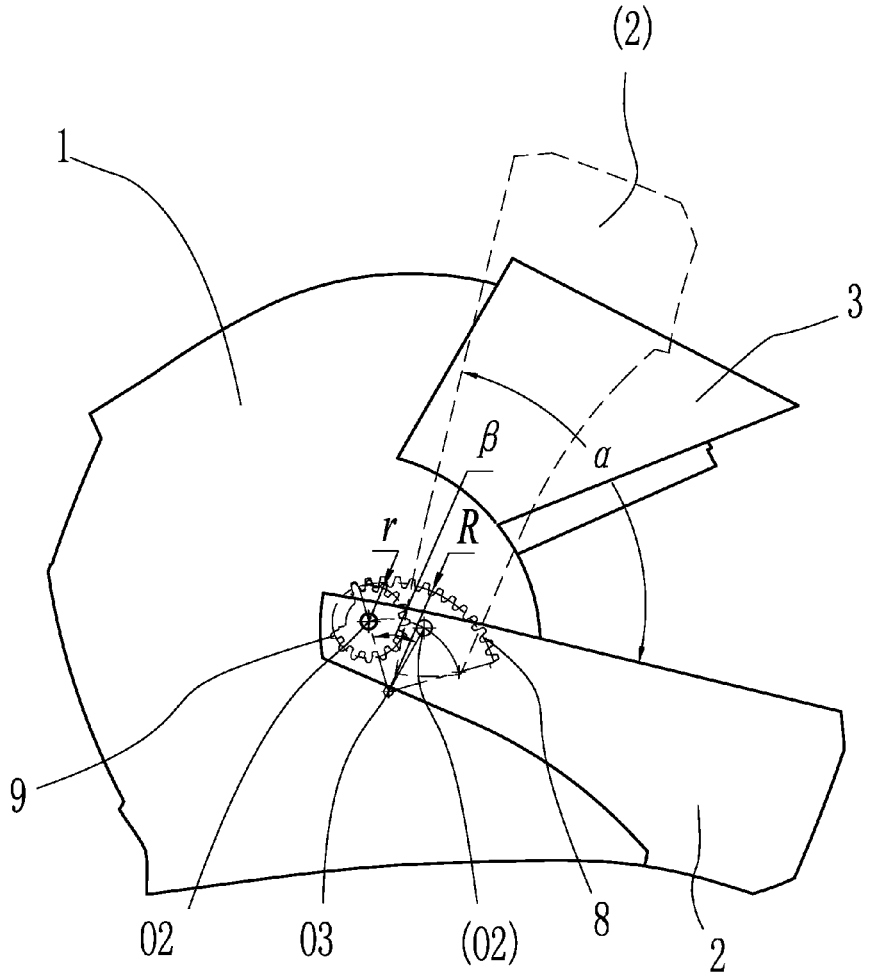
FIG. 15 is a schematic diagram of a relative geometrical relationship between the gear constraint mechanism of the helmet with changeable jaw guard shown in FIG. 7 and a pose of the jaw guard.

Further, for the engaged fixed gear 8 and rotary gear 9, as shown in FIG. 9 and FIG. 15, a pitch radius R of the fixed gear 8, a pitch radius r of the rotary gear and a corresponding central angle of rotation β of the axle centre 02 of the rotary gear 9 in case of an angle of rotation α of the jaw guard 2 relative to the helmet body 1 during the engagement, i.e., a central angle of rotation of the axle centre 02 obtained by measurement according to the fixed axis 03 (at this moment, the jaw guard 2 is turned from the full-helmet structure position to a position where the shield 3 is opened to an extreme, i.e., a position where the jaw guard 2→the jaw guard (2) and the corresponding axle centre 02 turns to the axle centre (02), i.e., the axle centre 02→the axle centre (02), see FIG. 15), these parameters meet a constraint formula $$\frac{R}{r} = 1 + \frac{\alpha}{\beta}.$$

It will be understood that by means of the above-described engagement constraint relationship between the fixed gear 8 and the rotary gear 9, the jaw guard 2 may achieve the function transition between the full-helmet structure and the half-helmet structure. Moreover, the position and posture of the jaw guard 2 may be precisely controlled during the structure transition.

In particular, in the helmet with changeable jaw guard which is equipped with the helmet shield opening mechanism described above according to the present disclosure, the fixed gear 8 may include a first fixed gear segment 8*a* and a second fixed gear segment 8*b*, and the rotary gear 9 may include a first rotary gear segment 9*a* and a second rotary gear segment 9*b*, and the first rotary gear segment 9*a* is only engaged with the first fixed gear segment 8*a* while the second rotary gear segment 9*b* is only engaged with the second fixed gear segment 8*b* (see FIGS. 8, and 10 to 12C). The purpose of such arrangement is to obtain a wider range of trajectory planning for the jaw guard 2 to accommodate the outer contour shape of the helmet body 1 so as to meet the needs of the jaw guard 2 passing through the shield 3 and returning to close the helmet body 1, i.e., the flexible design of the helmet may be achieved.

It should be noted that, when both the fixed gear 8 and the rotary gear 9 are provided with two gear segments, the constraint relationship between the corresponding engaged gear segments and the angle of rotation of the corresponding jaw guard 2 relative to the helmet body 1 must still meet the constraint formula of the parameters when the fixed gear 8 and the rotary gear 9 are in the form of one gear segment. Based on this, the axle centre 02 of the first rotary gear segment 9*a* may further overlap with the axle centre 02 of the second rotary gear segment 9*b* in present disclosure (see FIG. 10 to FIG. 12C), in this way, the jaw guard 2 may transform the structure more smoothly. Further, a first axle centre trajectory L1 of the first rotary gear segment 9*a* may further be tangent to a second axle centre trajectory L2 of the second rotary gear segment 9*b* at a point Q where they intersect in present disclosure (see FIG. 10 and FIG. 11), such arrangement has the same purpose that the jaw guard 2 may transform the structure more smoothly. It should be noted that if the number of teeth of the first rotary gear segment 9*a* is different from that of the second rotary gear segment 9*b*, the fixed axis 03 formed when the first axle centre trajectory L1 makes a motion in the form of a circular trajectory will not overlap with that formed when the second axle centre trajectory L2 makes a motion in the form of a circular trajectory (see FIG. 10 and FIG. 11).

In the helmet with changeable jaw guard which is equipped with the helmet shield opening mechanism described above according to the present disclosure, the driver element 4 is fastened to or integrally formed on the jaw guard 2. In this way, the driving action of the driver element 4 may be simplified so that the motion of the driver element 4 may be controlled more easily. Further, the driver element 4 is fastened to or integrally formed on the rotary gear 9 (see FIG. 8). In this case, the driver element 4 is more easily to be driven into motion. In particular, when the driver element 4 is of a cylindrical structure, an axis of rotation of the cylindrical structure may overlap with the axle centre02 of the rotary gear 9. The purpose of such arrangement is to further simplify the structure and drive mode of the driver element 4, so that the opening mechanism of the shield 3 may be simplified.

Figure 12C:
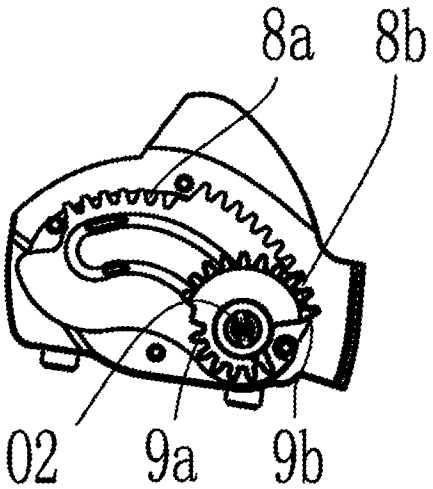
FIGS. 12A-C are a schematic diagrams of the gear constraint mechanism of the helmet with changeable jaw guard as shown in FIG. 11 in different operation states.
Figure 12B:
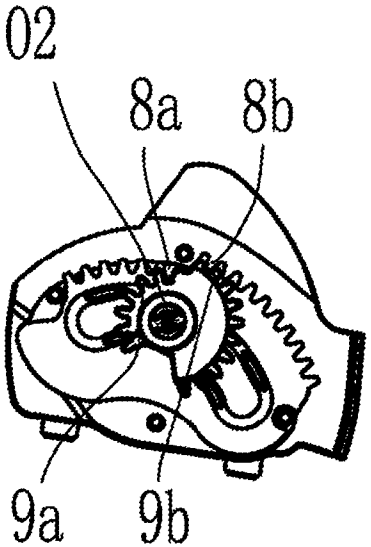
Figure 12A:
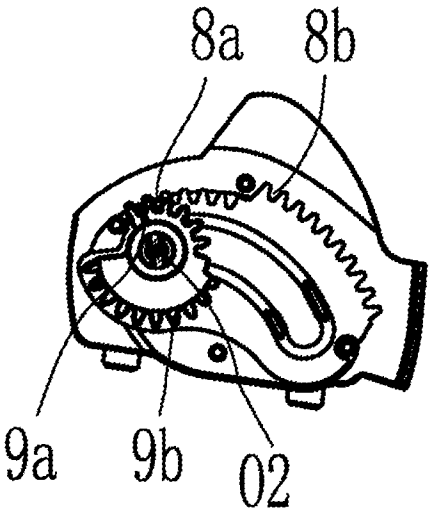

FIGS. 12A-C show schematic diagrams of the gear constraint mechanism of the helmet with changeable jaw guard in different operation states, wherein FIG. 12A corresponds to a position where the jaw guard 2 is in the full-helmet structure state, FIG. 12B corresponds to a position where the jaw guard 2 passes through the shield 3 (where the shield 3 is opened to an extreme) and FIG. 12C corresponds to a position where the jaw guard 2 is in the half-helmet structure state. FIGS. 13A-D show a changing process of the position and posture of the jaw guard 2 and the corresponding position of the driver element 4 driven by the of the jaw guard 2 when the jaw guard 2 is turned from the full-helmet structure position to the half-helmet structure position, wherein FIG. 13A corresponds to the state in which the jaw guard 2 is in the full-helmet structure position, the shield 3 is in a fully closed position and the corresponding driver element 4 is in an extreme position; FIG. 13B corresponds to the state in which the jaw guard 2 is in the open position and the corresponding driver element 4 comes into contact with and drives the first constraint track 3*b* to enable the shield 3 to be opened to an extreme; FIG. 13C corresponds to the state in which the jaw guard 2 has been completely turned to the half-helmet structure position and the corresponding driver element 4 has reached another extreme position; and FIG. 13D corresponds to the state in which the jaw guard 2 is in the half-helmet structure position, the shield 3 is returned to the fully closed position again, and the corresponding driver element 4 is still in the extreme position corresponding to the half-helmet structure position of the jaw guard 2. FIGS. 14A-D show a process for changing the position and posture of the jaw guard 2 and the corresponding position of the driver element 4 driven by the of the jaw guard 2 when the jaw guard 2 is returned to the full-helmet structure position from the half-helmet structure position, wherein FIG. 14A corresponds to the state in which the jaw guard 2 is in the half-helmet structure position, the shield 3 is in a fully closed position and the corresponding driver element 4 is in an extreme position; FIG. 14B corresponds to the state in which the jaw guard 2 is in the open position and the corresponding driver element 4 comes into contact with and drive the second constraint track 3*c* to enable the shield 3 to be opened to an extreme; FIG. 14C corresponds to the state in which the jaw guard 2 has been completely turned to the full-helmet structure position and the corresponding driver element 4 has reached another extreme position; and FIG. 14D corresponds to the state in which the jaw guard 2 is in the full-helmet structure position, the shield 3 is returned to the fully closed position again, and the corresponding driver element 4 is still in the extreme position corresponding to the full-helmet structure position of the jaw guard 2.

Compared with the prior art, the present disclosure has outstanding advantages that the first constraint track 3*b* and the second constraint track 3*c* are provided on at least one support leg 3*a* of the shield 3, and the driver element 4, configured to come into contact with the first constraint track 3*b* and/or the second constraint track 3*c* to drive the shield 3 to perform an opening action relative to the helmet body 1, is additionally provided. Therefore, on one hand, the shield may be opened forcedly as required; on the other hand, the opening process of the shield 3 may be planned flexibly. Meanwhile, the shield 3 can be opened smoothly without collision, thus improving the operational reliability of the shield opening mechanism and its positive influence on the wearing comfort of the helmet. Further, for the helmet with changeable jaw guard equipped with the helmet shield opening mechanism, the opening process of the shield 3 can be designed flexibly to adapt to different operation positions of the jaw guard 2, and are liable transition of the jaw guard 2 between a full-helmet position and a half-helmet position in case of being constrained by the gears is achieved, so that the operational reliability of the helmet can be effectively improved.

The above-described embodiments are merely a number of preferred embodiments of the present disclosure and are not intended to limit the scope of the disclosure. Therefore, any equivalent variations made in accordance with the structure, shape and principle of the present disclosure should fall within the scope of protection of the present disclosure.

What is claimed is:

1. A helmet with changeable jaw guard equipped with a helmet shield opening mechanism, wherein the jaw guard is a changeable jaw guard which produces a relative motion relative to the helmet body, a driver element is constrained and driven by the jaw guard so as to produce displacement and motion relative to the helmet body, wherein a fixed gear of internal tooth type is provided on the helmet body while a rotary gear of external tooth type is fastened to or integrally formed on the jaw guard, wherein the rotary gear and the fixed gear remain engaging with each other and constrains a course of motion of the jaw guard; and wherein for the engaged fixed gear and rotary gear, parameters being a pitch radius R of the fixed gear, a pitch radius r of the rotary gear and a corresponding central angle β rotated by an axle centre of the rotary gear when the jaw guard rotates an angle of α relative to the helmet body during engagement, meet a constraint formula:

$$\frac{R}{r} = 1 + \frac{\alpha}{\beta}.$$

2. The helmet with changeable jaw guard of claim 1, wherein the fixed gear comprises a first fixed gear segment and a second fixed gear segment, the rotary gear comprises a first rotary gear segment and a second rotary gear segment, and the first rotary gear segment only engages with the first fixed gear segment while the second rotary gear segment only engages with the second fixed gear segment.

3. The helmet with changeable jaw guard of claim 2, wherein an axle centre of the first rotary gear segment overlaps with that of the second rotary gear segment.

4. The helmet with changeable jaw guard of claim 3, wherein a first axle centre trajectory of the first rotary gear segment is tangent to a second axle centre trajectory of the second rotary gear segment in a point where they intersect.

5. The helmet with changeable jaw-guard according to claim 4, wherein the driver element is fastened to or integrally formed on the jaw guard.

6. The helmet with changeable jaw guard according to claim 5, wherein the driver element is fastened to or integrally formed on the rotary gear.

7. The helmet with changeable jaw-guard according to claim 3, wherein the driver element is fastened to or integrally formed on the jaw guard.

8. The helmet with changeable jaw guard according to claim 7 wherein the driver element is fastened to or integrally formed on the rotary gear.

9. The helmet with changeable jaw-guard according to claim 2, wherein the driver element is fastened to or integrally formed on the jaw guard.

10. The helmet with changeable jaw guard according to claim 9, wherein the driver element is fastened to or integrally formed on the rotary gear.

11. The helmet with changeable jaw-guard of claim 1, wherein the driver element is fastened to or integrally formed on the jaw guard.

12. The helmet with changeable jaw guard of claim 11, wherein the driver element is fastened to or integrally formed on the rotary gear.

* * * * *